United States Patent [19]

Berlese

[11] Patent Number: 4,640,027

[45] Date of Patent: Feb. 3, 1987

[54] MOTORCYCLE BOOT WITH POSITIVE AIR CIRCULATION

[76] Inventor: Remo Berlese, 31036 Ospedaletto di Istrana, Treviso, Italy

[21] Appl. No.: 790,108

[22] Filed: Oct. 22, 1985

[51] Int. Cl.[4] ..... A43B 5/14; A43B 7/06

[52] U.S. Cl. ..... 36/131; 36/3 R

[58] Field of Search ..... 36/131, 3 R, 3 B, 3 A, 36/113, 117, 29, 109

[56] References Cited

U.S. PATENT DOCUMENTS

| | | | |
|---|---|---|---|
| 426,495 | 4/1890 | Falkner | 36/3 R |
| 1,056,008 | 3/1913 | Cotton | 36/3 A |
| 1,213,941 | 1/1917 | Patrick | 36/3 A |
| 1,476,127 | 12/1923 | Williams | 36/3 A X |
| 2,480,035 | 8/1949 | Lindstrom | 36/3 R |
| 2,591,454 | 4/1952 | Manning | 36/3 A |
| 2,701,923 | 2/1955 | Toman | 36/3 R |
| 3,044,188 | 7/1962 | Evangelista | 36/3 R |
| 3,128,566 | 4/1964 | Burlison et al. | 36/3 R |
| 4,267,651 | 5/1981 | Albano | 36/131 |
| 4,587,749 | 5/1986 | Berlese | 36/131 |

FOREIGN PATENT DOCUMENTS

| | | | |
|---|---|---|---|
| 2489102 | 3/1982 | France | 36/131 |
| 436108 | 4/1951 | Italy | 36/3 A |
| 512046 | 11/1937 | United Kingdom | 36/3 A |

*Primary Examiner*—Werner H. Schroeder
*Assistant Examiner*—T. Graveline
*Attorney, Agent, or Firm*—Koppel & Harris

[57] ABSTRACT

A motorcycle boot is described with a positive air circulating system which distributes air over the wearer's foot in a continuously replenished flow. Air enters the boot through air scoops on the upper sides, travels down an intake duct at the rear, is distributed along the sole through a network of open channels, and flows against the underside of the wearer's foot through perforations in the inner sole. An exhaust path is provided through vent ports above the sole, exhaust ducts which run up the rear of the boot on either side of the intake duct, and vent openings which exhaust the air to the outside. Openings may be provided in the scoops immediately above the vent openings to produce a venturi action that stimulates the flow of air through the boot.

15 Claims, 7 Drawing Figures

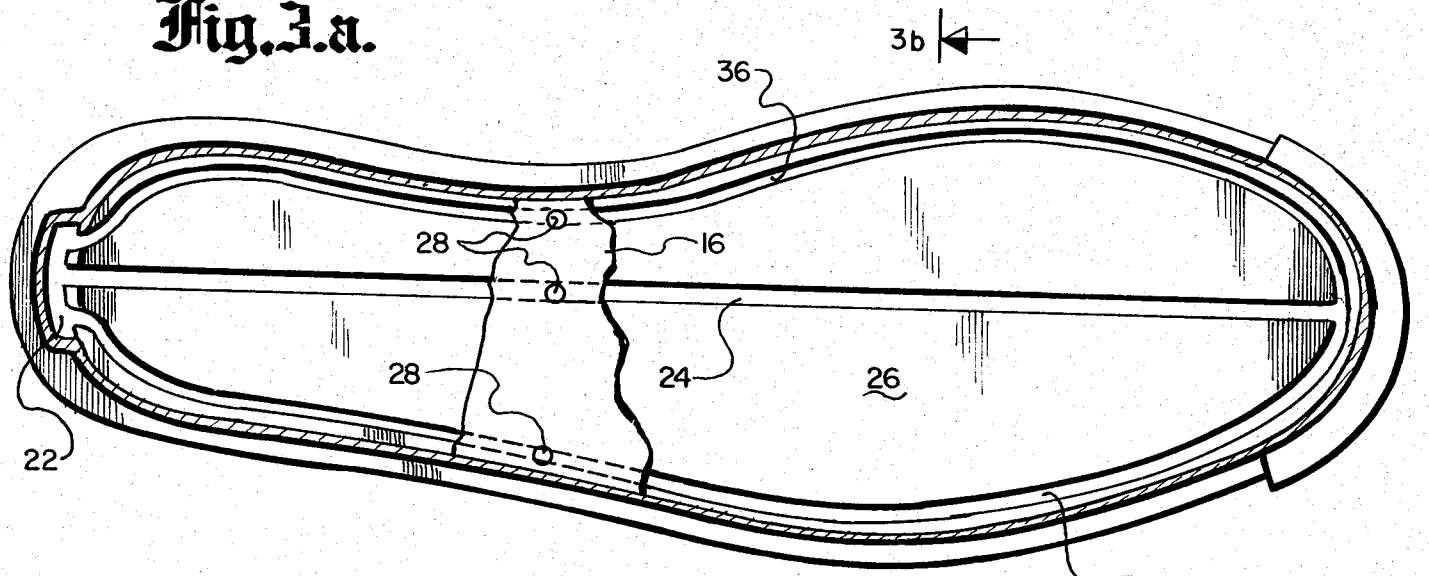
Fig. 3.a.
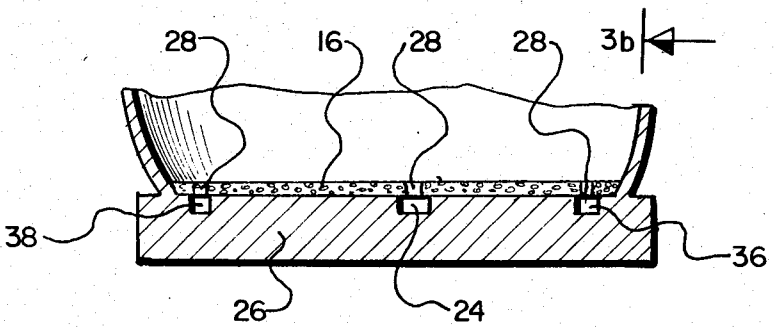
Fig. 3.b.

MOTORCYCLE BOOT WITH POSITIVE AIR CIRCULATION

BACKGROUND OF THE INVENTION

1. Field of the Invention

This invention relates to sportswear, and more particularly to boots specially adapted for motorcycle racing.

2. Description of the Prior Art

Motorcycle racing is a particularly strenuous activity, and is often performed under hot, dusty and generally uncomfortable conditions. Added to this is the fact that the rider's feet are frequently under a great deal of tension from supporting the rider's body in a continual shifting of weight back and forth from one foot to the other. With the heavy duty motorcycle boots that are worn for protection, the inside of the boots become uncomfortably hot. This can reduce racing performance and create a distraction which is both uncomfortable and unsafe.

It would be desirable to be able to cool the rider's feet inside the boots, particularly under high speed racing conditions. A venting system has been used for certain sports and recreational footwear which could be adapted for motorcycle boots, but would not provide an ideal solution. This system consists of simple openings or vent holes along the lower sides of the footwear, sometimes with a mesh covering over the opening. While such vents would lead to some introduction of cooling air into the interior of the boot under racing conditions, the coolingn effect is not very efficient. Furthermore, since racing often takes place under wet and muddy conditions, water and mud can get inside the boot through the openings and lead to more discomfort than with unvented boots.

SUMMARY OF THE INVENTION

In view of the above problems associated with the prior art, it is an object of the present invention to provide a novel and improved motorcycle boot having a superior ventilation system for cooling the wearer's feet, and which produces a positive air circulation through the boot.

Another object is the provision of such a vented motorcycle boot which also resists the introduction of water and dirt into the interior of the boot.

These and other objects are accomplished in the present invention by means of an air circulation system which brings a constantly replenished flow of air into the interior of the boot, distributes it under the wearer's foot, and then exhausts the air through a vent located above the bottom of the boot. In this manner a relatively large volume of air is circulated under and around the foot to give an improved cooling effect. A forward directed air scoop is located on the upper side of the boot and adapted to take in air when the wearer is riding forward on a motorcycle. The scoop is connected by means of an intake duct to an air distribution network fomed in the sole, which preferably comprises a series of open air channels in the upper portion of the sole. The circulation path is completed by an air exhaust which extends from the interior of the boot above the sole to the outside of the boot.

In a preferred embodiment the boot has an inner lining, with intake and exhaust ducts formed between the lining and the outer boot wall. The exhaust system consists of a plurality of air exhaust ports formed in the inner lining above the sole, exhaust ducts running up the rear of the boot from the exhaust ports and air vent openings at the upper ends of the exhaust ducts. An opening is provided at the rear of each scoop to jet out part of the incoming air near the exhaust vent. This provides a venturi action to stimulate the flow of exhaust air out of the vent, thereby enhancing a positive circulation of air into the boot through the air scoop, down the intake duct, through the air distribution network, out the exhaust ports, up the exhaust ducts, and out of the boot through the vent in response to forward motion of the boot.

Air intake scoops and vents are preferably located on both sides of the boot, and connect with adjacent intake and exhaust ducts running down the rear of the boot. The boot includes an inner sole overlying the sole, with the inner sole having a plurality of perforations over the air channels to transmit a flow of air up from the channels to the foot. In this manner a cooling flow of air is directed in a positive fashion over a large portion of the wearer's foot, and is continually replenished with fresh air taken in through the intake air scoop. The location of the air scoops and exhaust vents towards the upper end of the boot helps to prevent the entry of mud or water which may be splashed up from the ground.

These and other features and advantages of the invention will be apparent to those skilled in the art from the following detailed description of a preferred embodiment, taken together with the accompanying drawings, in which:

DESCRIPTION OF THE DRAWINGS

FIG. 3*a* is a plan view showing the upper side of the sole from inside the boot;

FIG. 3*b* is a sectional view taken along the line 3*b*–3*b* of FIG. 3*a;*

DETAILED DESCRIPTION OF A PREFERRED EMBODIMENT

Figure 1:
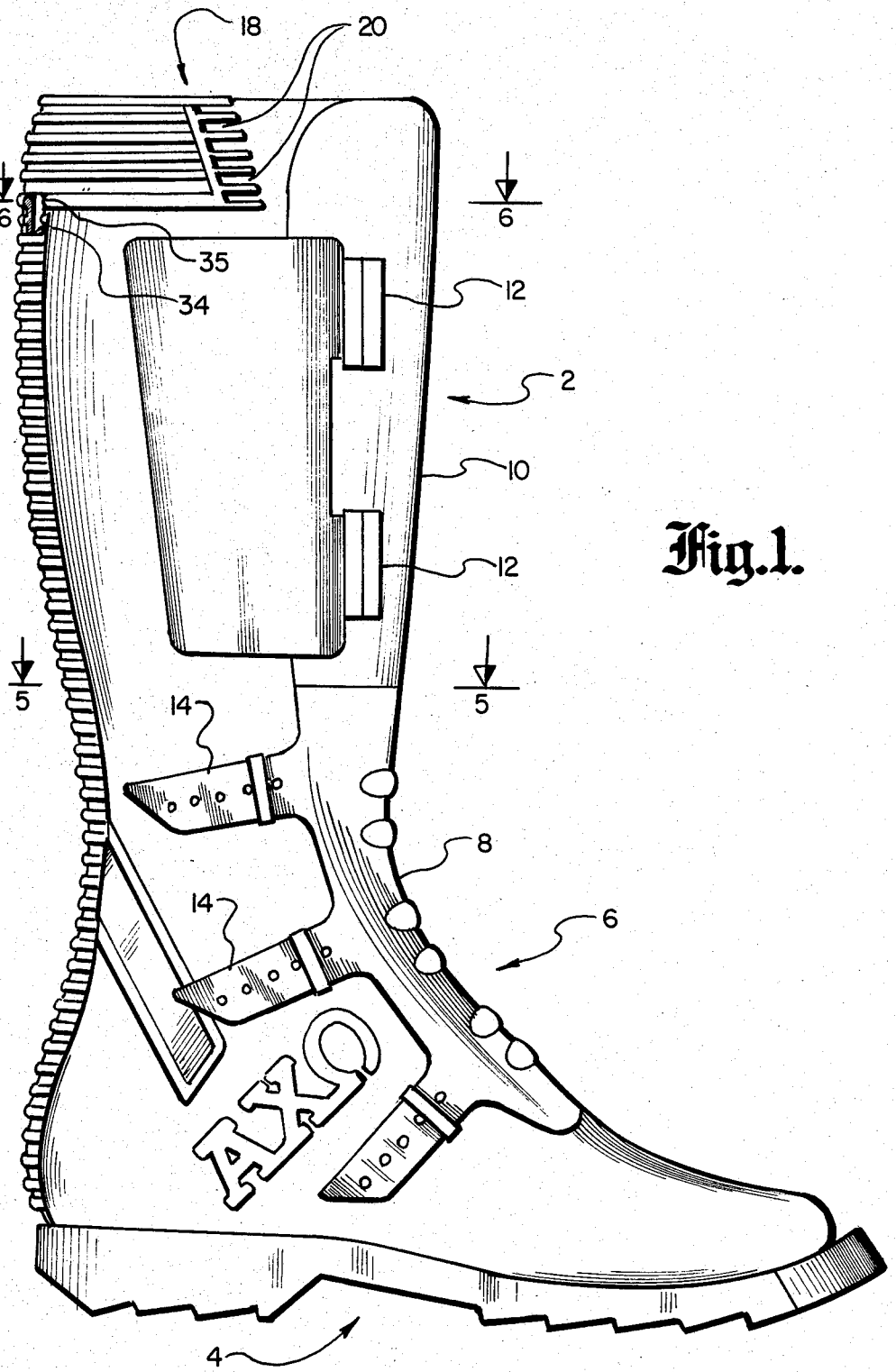
FIG. 1 is a side elevational view of a vented motorcycle boot constructed in accordance with the invention.

The overall configuration of the improved motorcycle boot of the present invention is shown in FIG. 1. The boot may be considered to comprise three general areas: an upper leg portion 2, a lower foot portion 4, and an intermediate ankle portion 6. The outside of the boot is mostly formed from a strong plastic material, preferably polyeurathane; a buckle section 8 below a shin guard 10 is formed from leather or other suitable material. The buckle section 8 and shin guard 10 are attached to the opposite side of the main boot from that seen in FIG. 1, and can be flexed to an open position to allow the wearer to insert or remove his foot. The shin guard includes a pair of buckles of VELCRO fastener sections 12 which mate with corresponding buckles on the main section of the boot to hold it closed, while a number of straps 14 extend to the side from the buckle section 8 and attach to corresponding buckles on the side of the main boot.

Figure 2:
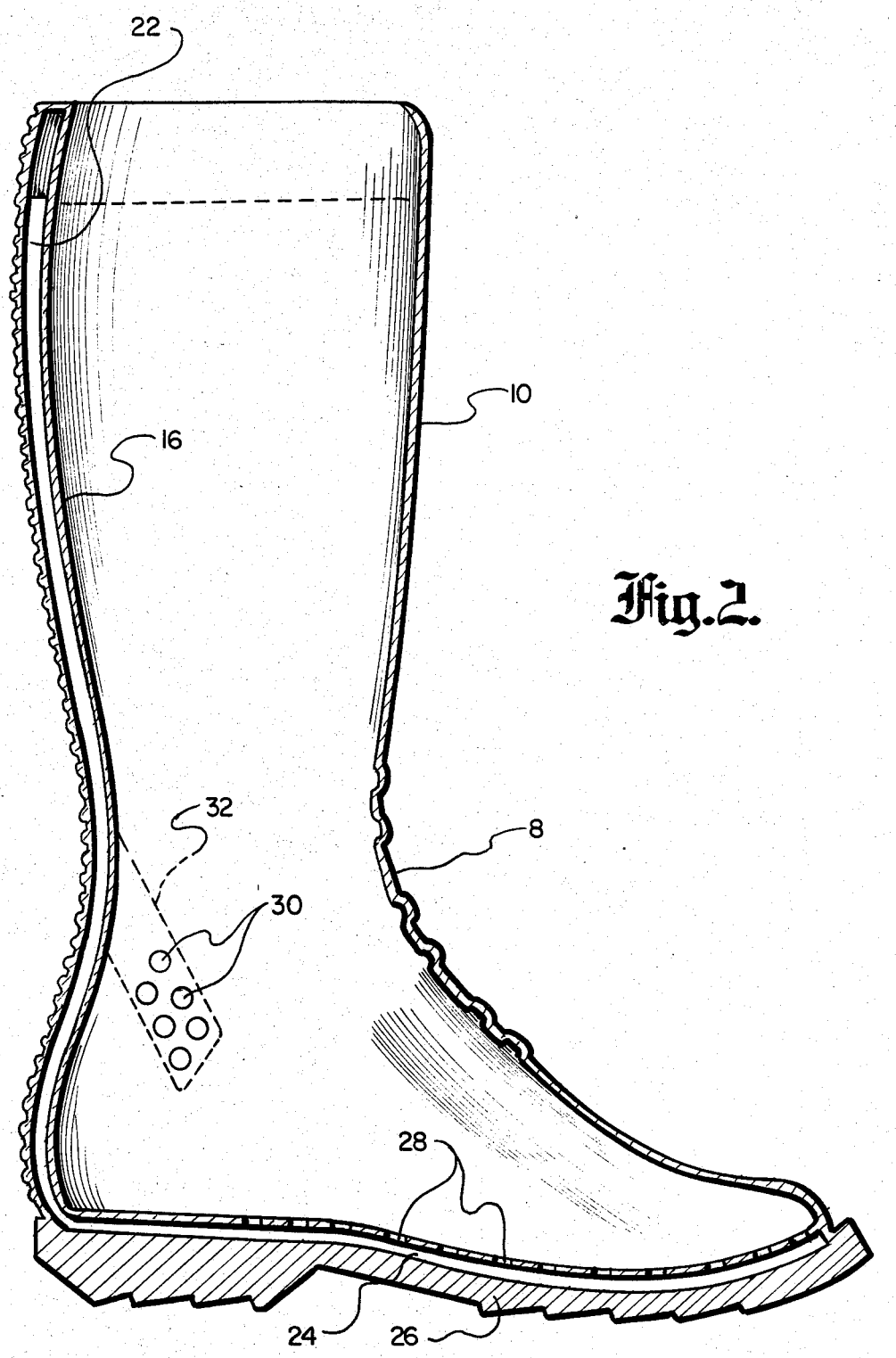
FIG. 2 is a sectional view of the boot shown in FIG. 1.

Referring now to FIGS. 1 and 2 together, an inner lining 16 of leather or other suitable material lines the sides, rear and bottom inside of the boot. An air scoop 18, consisting of a molded plastic piece with individual air inlet ports 20, is provided on the side of the boot at its upper end. The air inlets 20 communicate through channels formed in the scoop member with an air duct 22 that is formed between the lining 16 and the outer wall of the boot and extends in a generally vertical direction down the rear of the boot to the back of the heel. There is opens to a channel 24 which extends along the upper side of the sole 26 from the heel to the toe area. The lining 16 forms an inner sole at the bottom of the boot which rests over the sole and channel 24. A plurality of perforations 28 are provided in the lining in registration with channel 24 to admit air from inside the channel to the interior of the boot under the wearer's foot.

The structure described thus far enables a flow of air into the air scoop openings 20 when the wearer is moving forward on a motorcycle, down through intake duct 22, along channel 24 and up through perforations 28. A matrix of exhaust ports 30 are formed in the side of the boot above the sole in the general vicinity of the ankle to vent air from inside the boot. Exhaust ports 30 open to an exhaust duct 32 formed between the lining and outer boot wall on the side of the boot. This duct extends towards the rear of the boot and then runs up adjacent to the intake duct, as described below. The exhaust duct terminates at its upper end in an outlet opening 34 just below the air scoop member 18.

An opening 35 is provided in the rear wall of the lower portion of the scoop, immediately above exhaust vent 34. When the wearer is riding forward on a motorcycle a portion of the air entering the scoop is diverted from the intake duct 22 and instead jets out of opening 35. This produces a venturi action which stimulates the flow of exhaust air out of vent 34. Although the boot will provide adequate cooling without venturi opening 35, the air circulation and resultant cooling effect is enhanced if the venturi is provided. It should also be noted that the placement of the air scoop toward the top of the boot prevents substantial amounts of mud and water splashed up from the ground from entering the boot under most conditions. In rain or particularly wet conditions it may be desirable to provide a plug to close the air scoop openings, but excessive heat inside the boot is generally not a problem under wet conditions anyway.

Referring now to FIG. 3*a*, the upper side of sole 26 is shown with an air distribution network comprising a plurality of interconnected channels 24, 36 and 38, which open to intake duct 22 at the rear of the boot and extend along the upper portion of the sole to the toe area. Channel 24 extends down the center of the sole, while channels 36 and 38 run along each side. A sectional view of the sole with the channels is presented in FIG. 3*b*, with the leather inner sole lining 16 overlying the sole and including spaced perforations 28 in registration with the respective channels.

Figure 4:
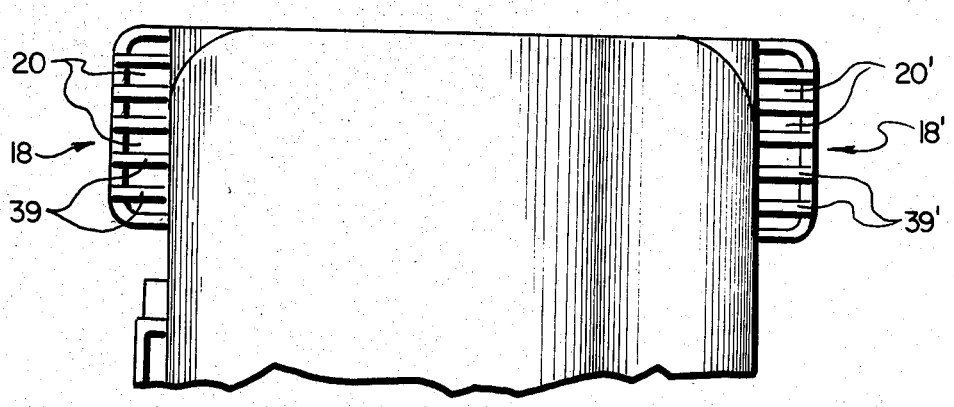
FIG. 4 is a fragmentary front elevational view of the upper end of the boot.

Referring now to FIG. 4, air scoop members 18 and 18′ are shown on opposite sides of the boot. Scoop 18′ is identical to scoop 18 and functions in the same manner. Each scoop includes a plurality of spaced ribs 39, 39′ which divide the scoop into parallel channels and extend from front to rear to hold the scoop wall out from the side of the boot, thus ensuring that the scoop remains open.

Figure 5:
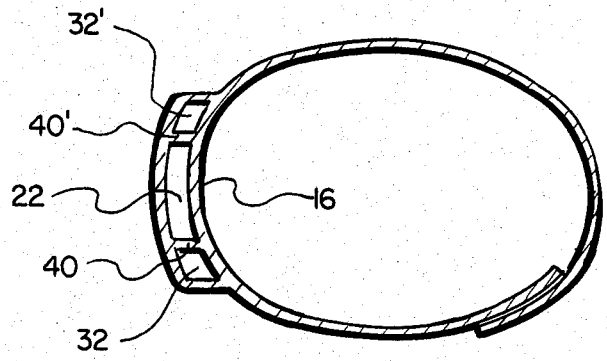
FIGS. 5 and 6 are sectional views taken along the lines 5—5 and 6—6 of FIG. 1, respectively.

FIG. 5 is a horizontal cross-section of the boot taken about mid-way between the top and bottom. Intake duct 22 is bounded in front by lining 16, in the rear by the outer boot wall, and laterally by ribs 40 and 40′ which extend down the length of the duct between the inner lining and outer boot wall. Exhaust ducts 32 and 32′ run vertically adjacent intake duct 22 and on either side thereof, each exhaust duct being bounded on one side by a common rib with the intake duct and on the other side by the outer boot wall.

Figure 6:
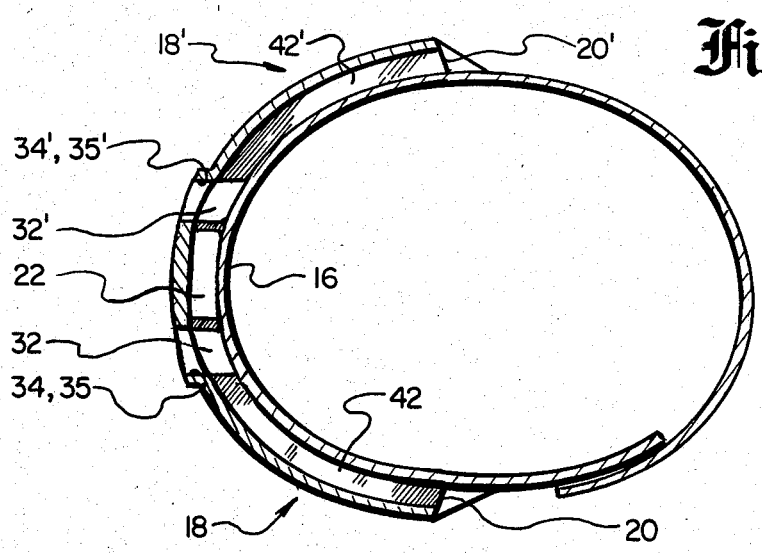

A sectional view of the air scoop members 18 and 18′ is shown in FIG. 6. Intake openings 20 and 20′ comprise the front ends of channels 42 and 42′ which extend around the boot to the intake duct 22 at the rear. Exhaust ducts 32 and 32′ terminate at vent openings 34 and 34′ immediately below venturi openings 35 and 35′ in the scoops.

In operation, the forward motion of the boot when the wearer is riding a motorcycle produces a circulating flow of air which enters the boot through intake openings 20, 20′, is transmitted via scoop channels 42, 42′ and intake duct 22 to channels 24, 36 and 38 along the sole of the boot, and from there through perforations 28 in the inner sole to the underside of the wearer's foot. The air flow then continues around both sides of the foot from heel to toe, through exhaust ports 30 (and 30′ on the opposite side of the boot, not shown in the drawings), up exhaust ducts 32, 32′, and out through exhaust vents 34, 34′. The flow of air is continuously replenished as the rider continues moving forward, producing a comfortable cooling effect that is enhanced by the stimulated air flow produced by venturi openings 35, 35′.

While a particular embodiment of the invention has been shown and described, numerous modifications and alternate embodiments will occur to those skilled in the art. Accordingly, it is intended that the invention be limited only in terms of the appended claims.

I claim:

1. In a motorcycle boot having a lower foot portion with a bottom sole, an upper leg portion and an intermediate ankle portion, the improvement comprising:

forward directed air scoop means on the exterior of the boot adapted to take in air in response to the wearer riding forward on a motorcycle, an air distribution network at the sole for distributing intake air along the underside of the wearer's foot, intake duct means providing a passageway to deliver air taken in by the air scoop means to the air distribution network, and an air exhaust means extending from a location in the interior of the boot above the bottom of the foot to the exterior of the boot for venting air which has entered the air scoop means and flowed through the intake duct means to the air distribution network, the air exhaust means completing a circulation path through the boot for air which has entered the boot through the air scoop means.

2. The motorcycle boot of claim 1, the air exhaust means comprising exhaust port means located above the sole and providing an air exhaust path from the interior of the boot, an air vent means for venting exhaust air to the exterior of the boot, and an exhaust duct means communicating between the exhaust port means and the air vent means.

3. The motorcycle boot of claim 2, wherein the air scoop means is located on the upper portion of the boot, and the intake duct means runs generally vertically between the air scoop means and the air distribution network.

4. The motorcycle boot of claim 3, wherein the air vent means is locaed on the upper portion of the boot in the vicinity of the air scoop means, and the exhaust duct means runs generally vertically between the exhaust port means and the air vent means.

5. The motorcycle boot of claim 4, wherein the intake and exhaust duct means comprise generally parallel ducts extending generally vertical along the rear of the boot.

6. The mototcycle boot of claim 1, wherein the air distribution network comprises a plurality of open air channels formed in the upper portion of the sole.

7. The motorcycle boot of claim 6, wherein the air distribution channels are distributed along both the central and side portions of the sole.

8. In a motorcycle boot having a lower foot portion with a bottom sole, an upper leg portion, an intermediate ankle portion, an outer wall and an inner lining adjacent the outer wall, the improvement comprising:

forward directed air scoop means on the upper exterior portion of the boot adapted to take in air in response to the wearer riding forward on a motorcycle, a network of open air channels formed in the upper portion of the sole for distributing intake air along the underside of the wearer's foot, intake duct means formed between the boot's outer wall and inner lining and extending between the air scoop means and the air channels in the sole to provide a path to deliver air taken in by the air scoop means to the air distribution channels, a plurality of air exhaust ports formed in the inner lining above the bottom of the foot to receive air delivered to the air distribution channels from the air scoop means, an air vent means for venting exhaust air to the exterior of the boot, and exhaust duct means formed between the boot's outer wall and inner lining and extending between the air exhaust ports and the air vent means to deliver exhaust air from the exhaust ports to the air vent means, whereby a positive flow of cooling air is established past the wearer's foot through, in succession, the air scoop means, intake duct means, distribution channels, exhaust ports, exhaust duct means and air vent means in response to forward movement of the boot.

9. The motorcycle boot of claim 8, wherein the air vent means is located on the upper portion of the boot in the vicinity of the air scoop means, the air scoop means extends from the side of the boot toward the rear, and the intake and exhaust duct means extend parallel to each other generally along the rear of the boot.

10. The motorcycle boot of claim 9, wherein the air distribution network comprises a plurality of open air channels formed in the upper portion of the sole.

11. The motorcycle boot of claim 10, wherein the air distribution channels are distributed along both the central and side portions of the sole.

12. In a motorcycle boot having a lower foot portion with a bottom sole, an upper leg portion, an intermediate ankle portion, an outer wall and an inner lining adjacent the outer wall, the improvement comprising:

forward directed air scoop means on both sides of the boot, extending from the side of the boot toward the rear on the upper exterior portion of the boot, the air scoop means being adapted to take in air when the wearer is riding forward on a motorcycle, a network of open air channels formed in the upper portion of the sole for distributing intake air along the underside of the wearer's foot, intake duct means formed between the boot's outer wall and inner lining and extending between the air scoop means and the air channels in the sole to provide an air intake path between the air scoop means and air distribution channels, the intake duct means comprising a duct formed by lateral parallel ribs which extend between the outer wall of the boot and the inner lining, a plurality of air exhaust ports formed in the inner lining above the sole, an air vent means located on the upper portion of the boot in the vicinity of the air scoop means for venting exhaust air to the exterior of the boot, and exhaust duct means formed between the boot's outer wall and inner lining and extending between the air exhaust ports and the air vent means, the intake and exhaust duct means extending parallel to each other generally along the rear of the boot, the exhaust duct means comprising a pair of ducts formed on opposite lateral sides of the intake duct and sharing respective ribs therewith, whereby a positive flow of cooling air is established past the wearer's foot through the air scoop means, intake duct means, distribution channels, exhaust ports, exhaust duct means and air vent means in response to forward movement of the boot.

13. The motorcycle boot of claim 12, wherein a plurality of air exhaust ports are provided in the inner lining on either side of the boot in the vicinity of the ankle, the exhaust duct on either side of the boot extending to the exhaust ports on its side.

14. The motorcycle boot of claim 12, wherein the air scoop means on each side of the boot comprise respective unitary pieces of molded plastic having forward directed air openings and channels extending between the air openings and the intake ducts, each scoop including a rearward directed opening closely proximate to the air vent opening on its side, foward motion of the boot on a motorcycle causing a portion of the air entering the scoop to jet out the scoop opening to provide a venturi action which stimulates the flow of exhaust air out of the air vent opening, thereby establishing an enhanced positive circulation of air into the boot through the air scoop means, down the intake duct, through the air distribution network, out the exhaust ports, up the exhaust ducts, and out of the boot through the vent openings in response to forward motion of the boot.

15. The motorcycle boot of claim 12, wherein the air vent means comprises openings at the upper ends of the exhaust ducts.

* * * * *